US011655585B2

(12) United States Patent
Song et al.

(10) Patent No.: US 11,655,585 B2
(45) Date of Patent: May 23, 2023

(54) IRON-STEAMER APPLIANCE

(71) Applicant: Hamilton Beach Brands, Inc., Glen Allen, VA (US)

(72) Inventors: Brandon Sung-Hwan Song, Glen Allen, VA (US); Drew Carlson, Midlothian, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 455 days.

(21) Appl. No.: 16/385,752

(22) Filed: Apr. 16, 2019

(65) Prior Publication Data

US 2020/0332458 A1 Oct. 22, 2020

(51) Int. Cl.

| | |
|---|---|
| ***D06F 75/20*** | (2006.01) |
| ***D06F 75/38*** | (2006.01) |
| ***D06F 75/14*** | (2006.01) |
| ***D06F 75/26*** | (2006.01) |

(52) U.S. Cl.

CPC ..... *D06F 75/20* (2013.01); *D06F 75/14* (2013.01); *D06F 75/38* (2013.01); *D06F 75/26* (2013.01)

(58) Field of Classification Search

CPC ..... D06F 75/20; D06F 75/38; D06F 75/14; D06F 75/26

USPC ..... 38/77.83

See application file for complete search history.

(56) References Cited

U.S. PATENT DOCUMENTS

| | | | | |
|---|---|---|---|---|
| 3,294,607 | A * | 12/1966 | Rothermel | F16L 11/112 156/144 |
| 4,640,028 | A | 2/1987 | Nakada et al. | |
| 5,630,287 | A | 5/1997 | Shimosaka et al. | |
| 6,031,969 | A | 2/2000 | Burr | |
| 6,061,935 | A | 5/2000 | Lee | |
| 7,490,422 | B1 * | 2/2009 | Chen | D06F 75/10 38/75 |
| 7,516,565 | B1 * | 4/2009 | Tsen | A47L 13/22 15/321 |
| 2007/0102414 | A1 * | 5/2007 | Jiang | D06F 75/10 219/245 |
| 2010/0146826 | A1 * | 6/2010 | Lee | D06F 75/16 38/77.83 |
| 2016/0053429 | A1 * | 2/2016 | Stamper | D06F 75/18 38/77.81 |

* cited by examiner

*Primary Examiner* — Nathan E Durham
*Assistant Examiner* — Abby M Spatz
(74) *Attorney, Agent, or Firm* — Alexander D. Raring

(57) ABSTRACT

An iron-steamer appliance includes: a housing including an internal water reservoir; a sole plate attached under the housing, the sole plate including first vents; first and second steam chambers in fluid communication with the water reservoir, wherein the first steam chamber is in fluid communication with the first vents; and a steamer nozzle in fluid communication with the second steam chamber, the steamer nozzle including second vents. The steamer nozzle is movable between retracted and extended positions, wherein in the retracted position, the nozzle is located directly above a peripheral footprint defined by the sole plate, and in the extended position, the nozzle is located at least partially forwardly of the sole plate peripheral footprint, and wherein in moving from the retracted position to the extended position, the steamer nozzle moves substantially parallel to the sole plate.

15 Claims, 18 Drawing Sheets

IRON-STEAMER APPLIANCE

FIELD OF THE INVENTION

The present invention relates generally to an iron, and more particularly to a combined iron and steamer appliance.

BACKGROUND

Domestic irons are known for pressing and removing wrinkles from fabric. Domestic steam irons employ a heated sole plate that contacts a garment to remove wrinkles, wherein apertures in the soleplate are provided to permit the transmission of steam to the garment. However, certain delicate garments cannot be ironed because of the likelihood of damage. To remove wrinkles from delicate garments or to generally avoid using a soleplate and/or ironing board, a steamer is typically employed. A steamer is a device that emits steam toward the garment, but does not typically directly contact the garment.

More recently, irons and steamers have been combined into a single device for convenience of the user. Such combined iron/steamer devices typically employ a motor and pump to transfer water from a water reservoir in the device to a steam chamber, where the water comes into contact with a heater to generate the steam. With the motor and pump, a high flow rate is achieved to provide a constant steam flow toward the garment.

Alternatively, a combined iron-steamer may rely on gravity to feed steam to the iron and steamer. Such a device is described in U.S. Pat. No. 9,200,403, the disclosure of which is hereby incorporated herein by reference in full. The device discussed in the '403 patent, supra, includes a nozzle attached to the sloping front portion of the iron (sometimes referred to as the "nose") to provide the steaming function. The device includes two separate chambers that provide water exclusively to either the steaming nozzle or the soleplate. From a rest position in which no steam is emitted, the steamer nozzle slides downwardly and forwardly along the profile of the nose of the iron for steaming.

It may be desirable to provide additional iron-steamer configurations that are simpler, more elegant, more effective, and/or more aesthetically pleasing to the consumer.

SUMMARY

As a first aspect, embodiments of the invention are directed to an iron-steamer appliance. The iron-steamer appliance comprises: a housing including an internal water reservoir; a sole plate attached under the housing, the sole plate including first vents; first and second steam chambers in fluid communication with the water reservoir, wherein the first steam chamber is in fluid communication with the first vents; and a steamer nozzle in fluid communication with the second steam chamber, the steamer nozzle including second vents. The steamer nozzle is movable between retracted and extended positions, wherein in the retracted position, the nozzle is located directly above a peripheral footprint defined by the sole plate, and in the extended position, the nozzle is located at least partially forwardly of the sole plate peripheral footprint, and wherein in moving from the retracted position to the extended position, the steamer nozzle moves substantially parallel to the sole plate.

As a second aspect, embodiments of the invention are directed to an iron-steamer appliance comprising: a housing including an internal water reservoir; a sole plate attached under the housing, the sole plate including first vents; first and second steam chambers in fluid communication with the water reservoir, wherein the first steam chamber is in fluid communication with the first vents; and a steamer nozzle in fluid communication with the second steam chamber, the steamer nozzle including second vents. The steamer nozzle is movable between retracted and extended positions, wherein the retracted position, the second vents directly overlie the sole plate, and in the extended position, the second vents do not overlie the sole plate.

As a third aspect, embodiments of the invention are directed to an iron-steamer appliance comprising: a housing including an internal water reservoir; a sole plate attached under the housing, the sole plate including first vents; first and second steam chambers in fluid communication with the water reservoir, wherein the first steam chamber is in fluid communication with the first vents; and a steamer nozzle in fluid communication with the second steam chamber, the steamer nozzle including a housing and second vents. The steamer nozzle is movable between retracted and extended positions, and wherein in the retracted position the steamer nozzle housing follows a contour defined by the appliance housing, and in the extended position, the steamer nozzle housing is forward of the contour defined by the appliance housing.

DETAILED DESCRIPTION

Figure 1:
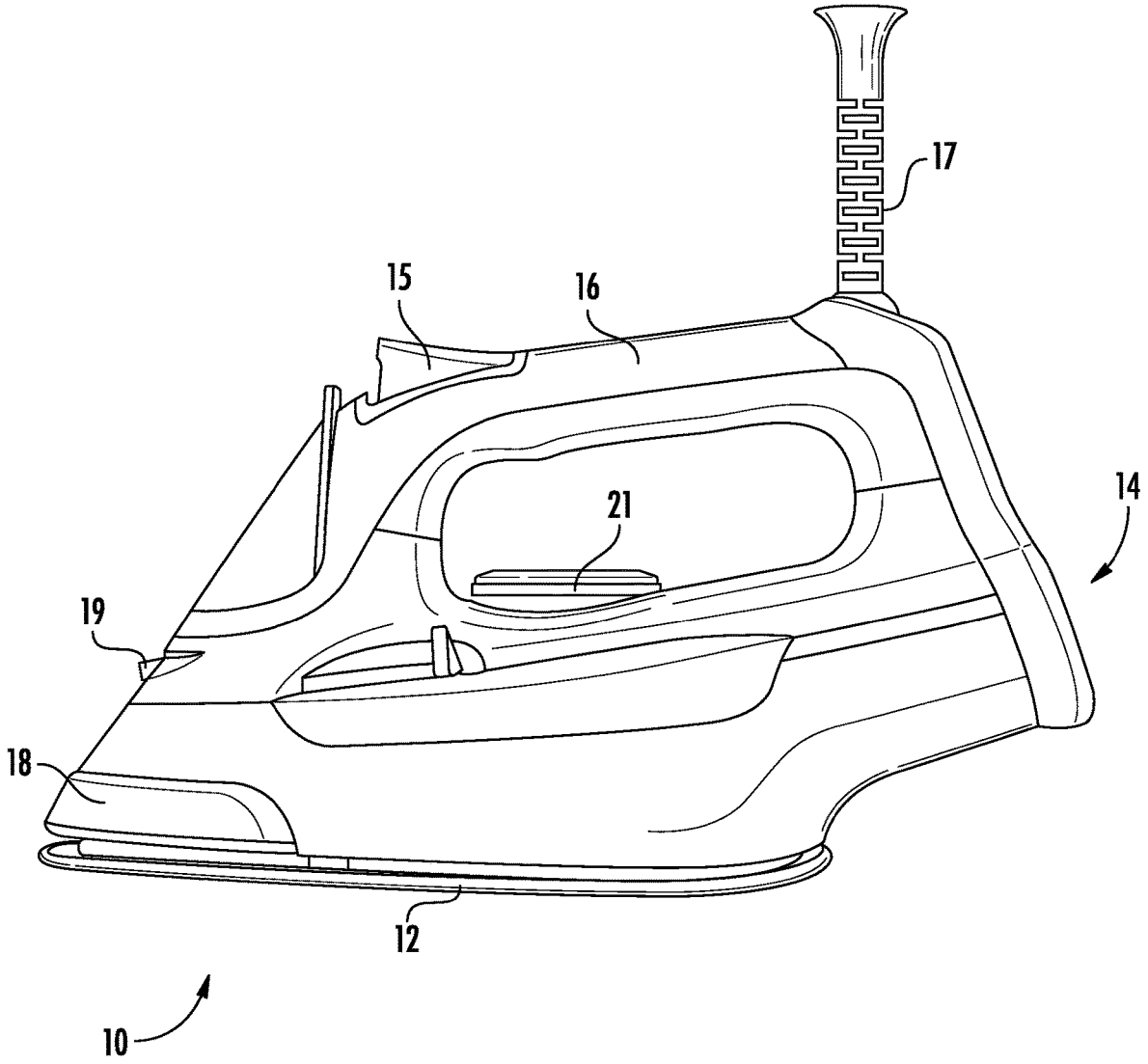
FIG. 1 is a perspective view of an iron-steamer appliance according to embodiments of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Referring now to the drawings, a combination iron-steamer, designated broadly at 10, is shown in FIGS. 1-24. Referring first to FIG. 1, the iron-steamer 10 includes a soleplate 12, a body 14 with a handle 16, and a steamer nozzle 18. A steam release button 15 is attached to the handle 16, as is a power cord 17. The body 14 may be formed from multiple components, some of which, as described below, may provide additional functions. The soleplate 12, which includes vents 12*a* and a cover plate 12*b* (see FIG. 5), is of conventional construction with the exceptions discussed below. A heating element (not shown) heats the soleplate 12 such that its lower surface is warmed to enable it to remove wrinkles from garments and other fabric items. A water port 19 is located on the front of the body 14 to receive water that is converted to steam. A dial 21 is mounted to the upper surface of the body 14 below the handle 16 to regulate the temperature of the soleplate 12.

Figure 2:
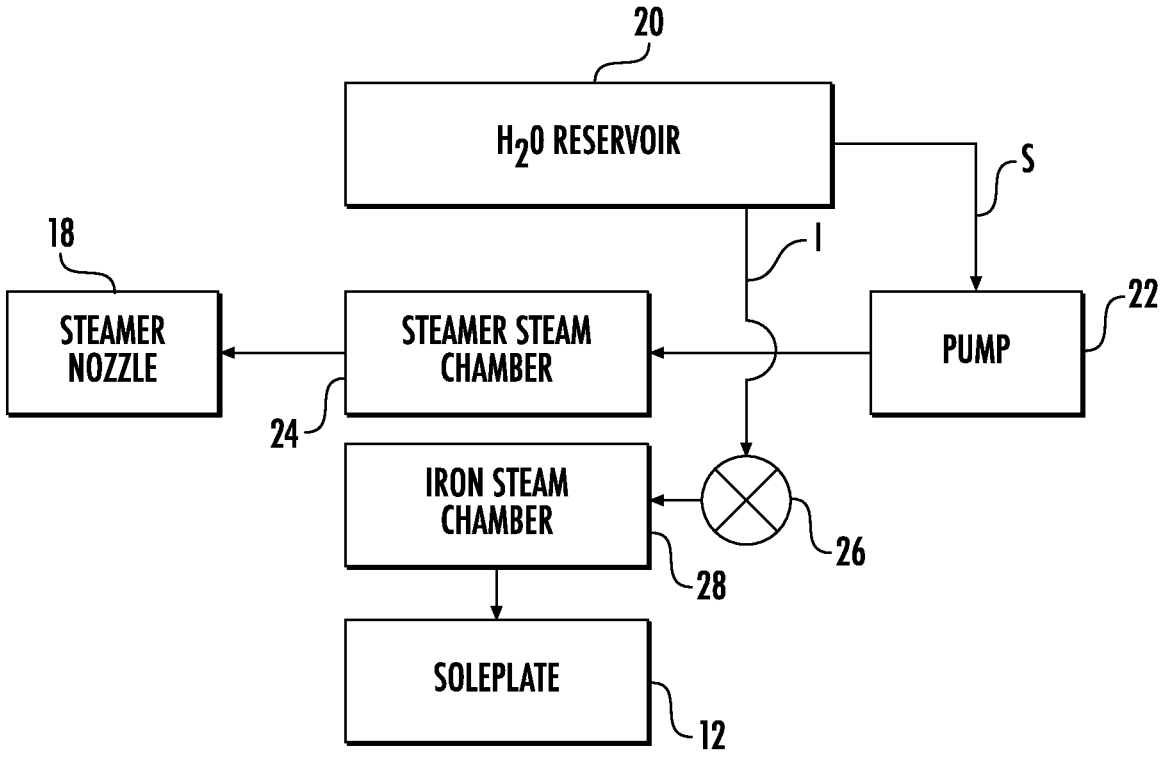
FIG. 2 is a schematic diagram illustrating the flow of water and steam through the iron-steamer of FIG. 1.

Internally, and as shown schematically in FIG. 2, within the body 14 the iron-steamer 10 includes a water reservoir 20 (fed by the water port 19) that is fluidly connected to two separate pathways: a steamer pathway S and an iron pathway I. The steamer pathway S includes a pump 22 that is connected to a steamer steam chamber 24 that is in turn fluidly connected to the steamer nozzle 18. The iron pathway I includes a valve 26 that is fluidly connected to an iron steam chamber 28, which is in turn fluidly connected with the vents 12*a* in the soleplate 12.

Figure 6:
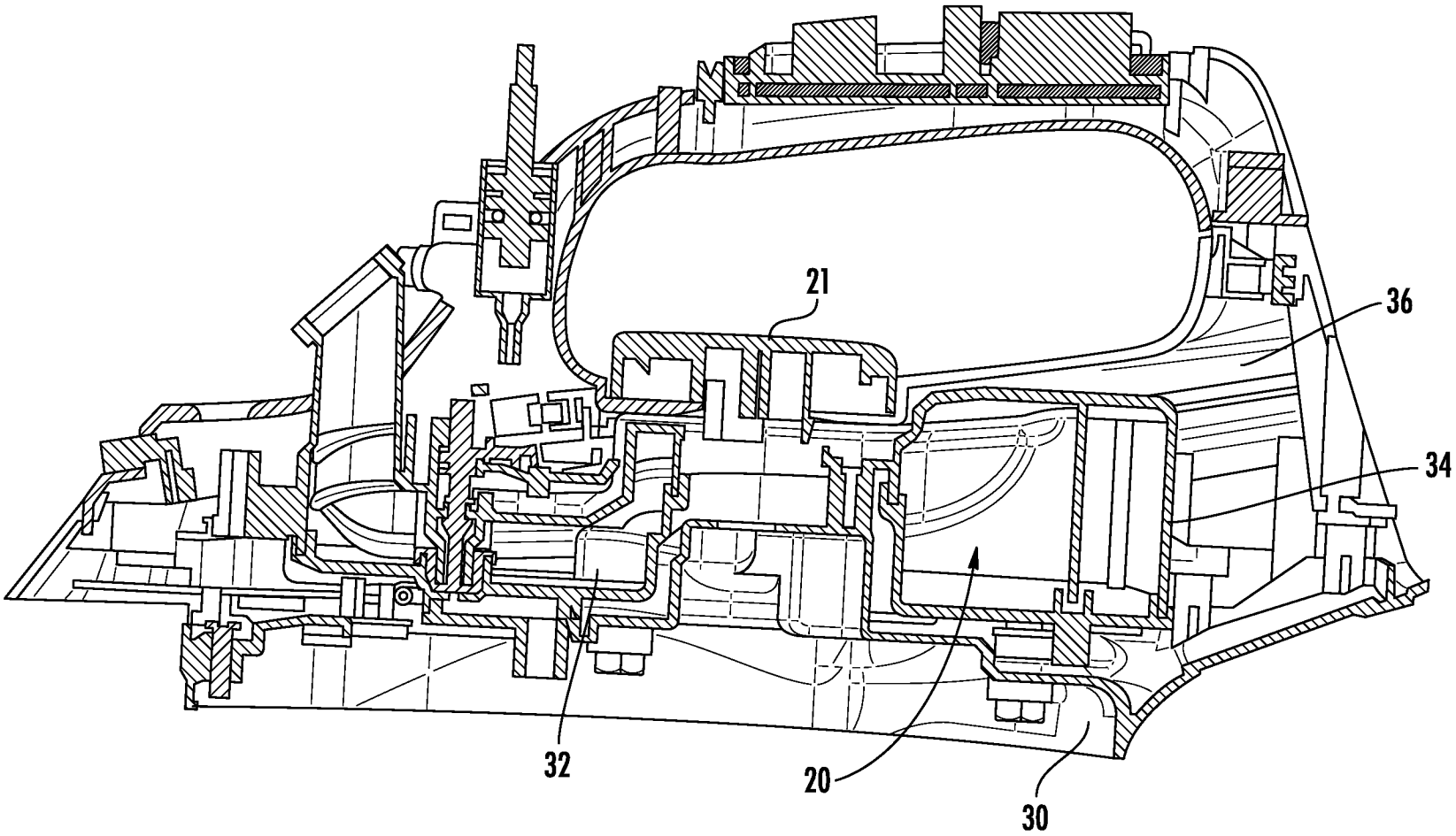
FIG. 6 is a side section view of the iron-steamer of FIG. 1 without the sole plate and cover plate of FIGS. 3-5.

Referring now to FIG. 6, the body 14 of the iron-steamer 10 includes a routing plate 30, a water reservoir floor 32, a water reservoir ceiling 34, and a cover 36 (on which the dial 21 is mounted). The water reservoir floor 32 and ceiling 34 combine to form the water reservoir 20. Specific details of these components are discussed below.

Figure 3:
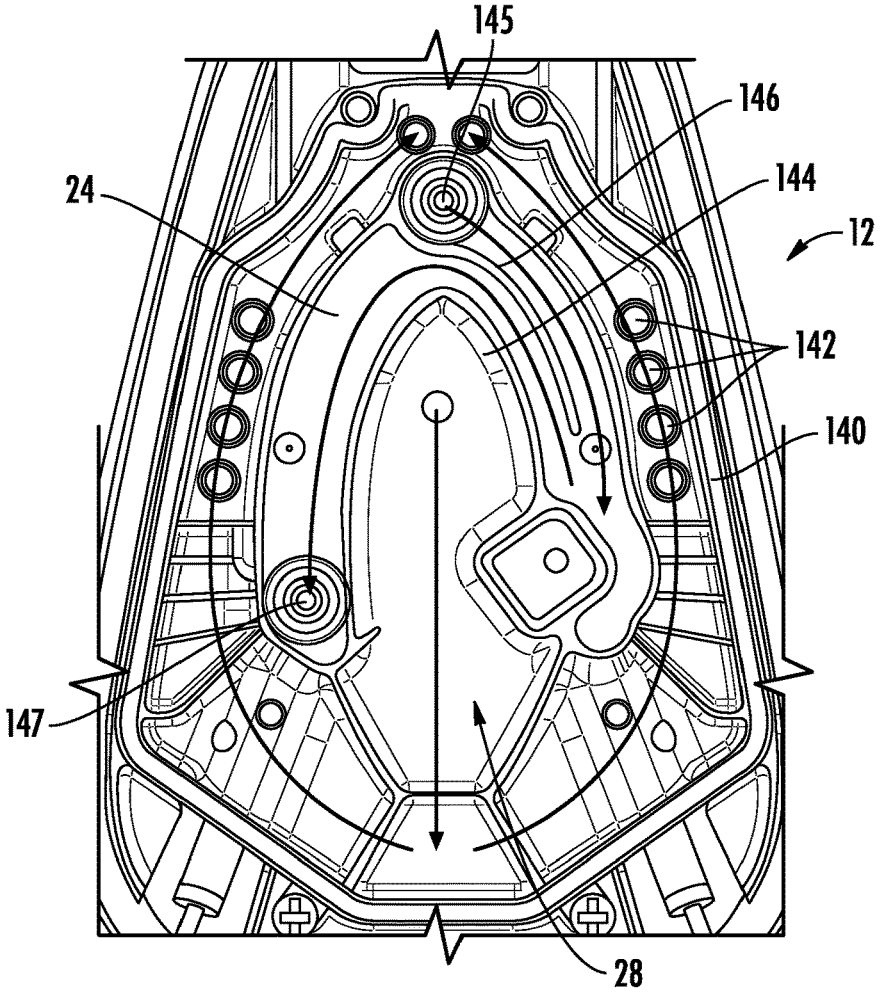
FIG. 3 is a cutaway top view of the sole plate of the iron-steamer of FIG. 1.
Figure 4:
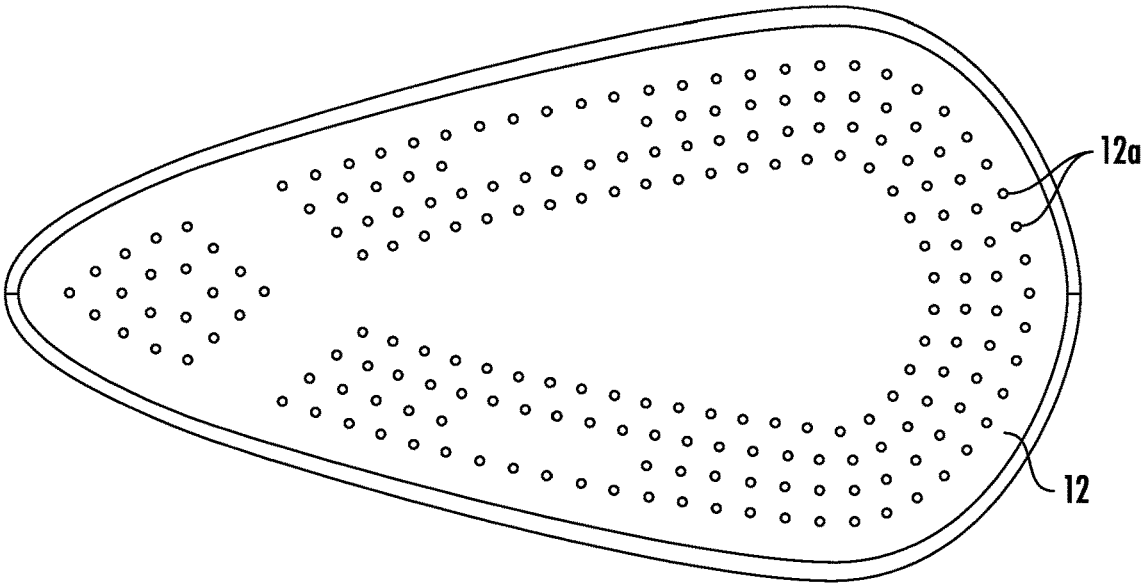
FIG. 4 is a bottom view of the sole plate of FIG. 3.

Referring to FIGS. 3 and 4, the sole plate 12 includes an outer wall 140 that defines the outer periphery of the iron steam chamber 28. The vents 12*a* are fed via multiple ports 142 within the iron steam chamber 28. An inner wall 144 is located within the periphery of the iron steam chamber 28 and serves to separate the steamer and iron steam chambers 24, 28. The inner wall 144 is routed to define a separated horseshoe-shaped space within the iron steam chamber 28. An entry port 145 is located at "apex" of the "horseshoe", and an exit port 147 is located at the end of one of the "legs" of the "horseshoe." A divider 146 is present that divides the other of the "legs" of the "horseshoe" longitudinally to increase the flow length from the entry port 145 to the exit port 147. The cover plate 12*b* meets the upper edges of the outer wall 140 and the inner wall 144 to seal the steam chambers 24, 28.

Figure 7:
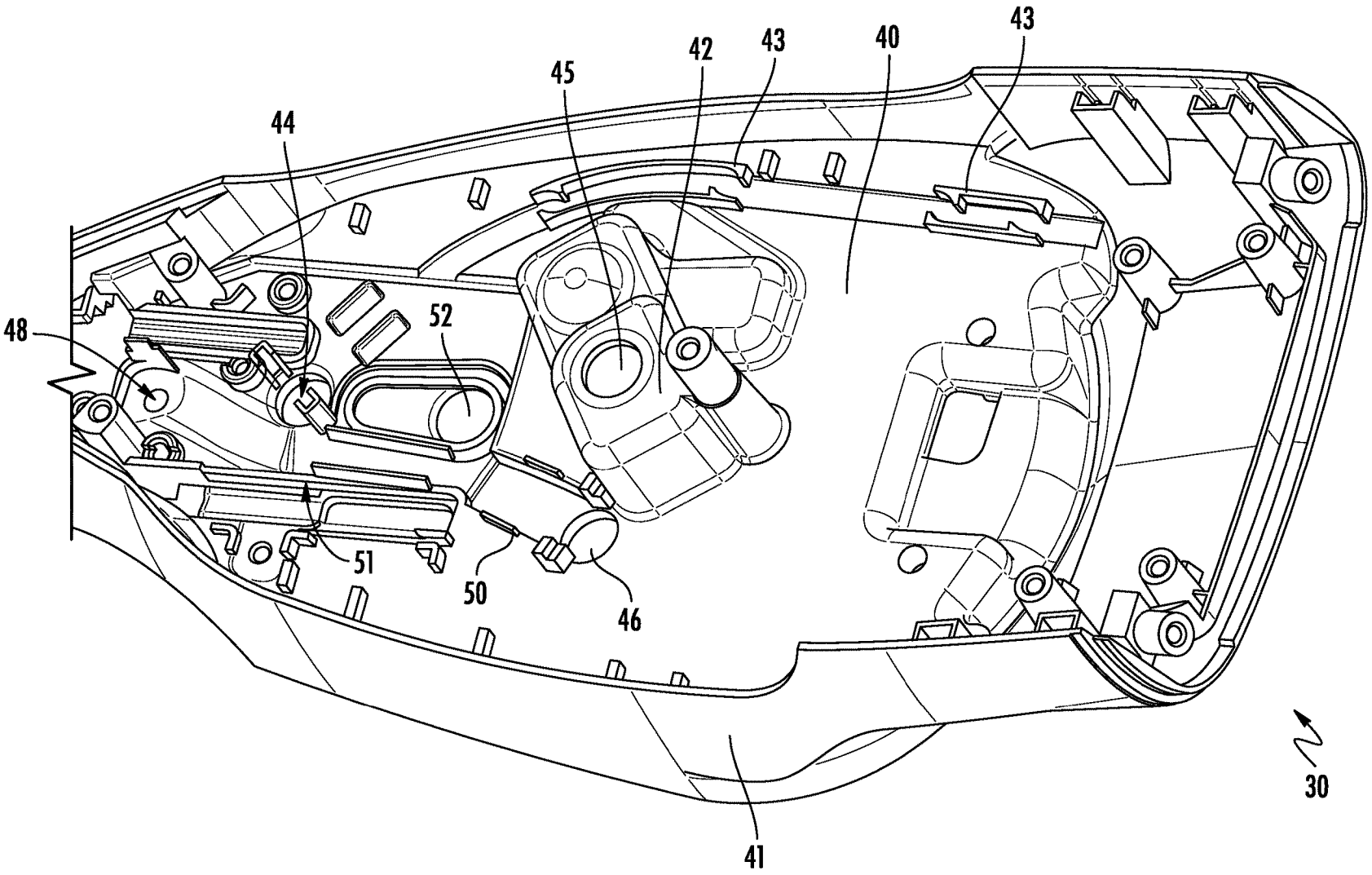
FIG. 7 is a top perspective view of the routing plate of the iron-steamer of FIG. 1.
Figure 8:
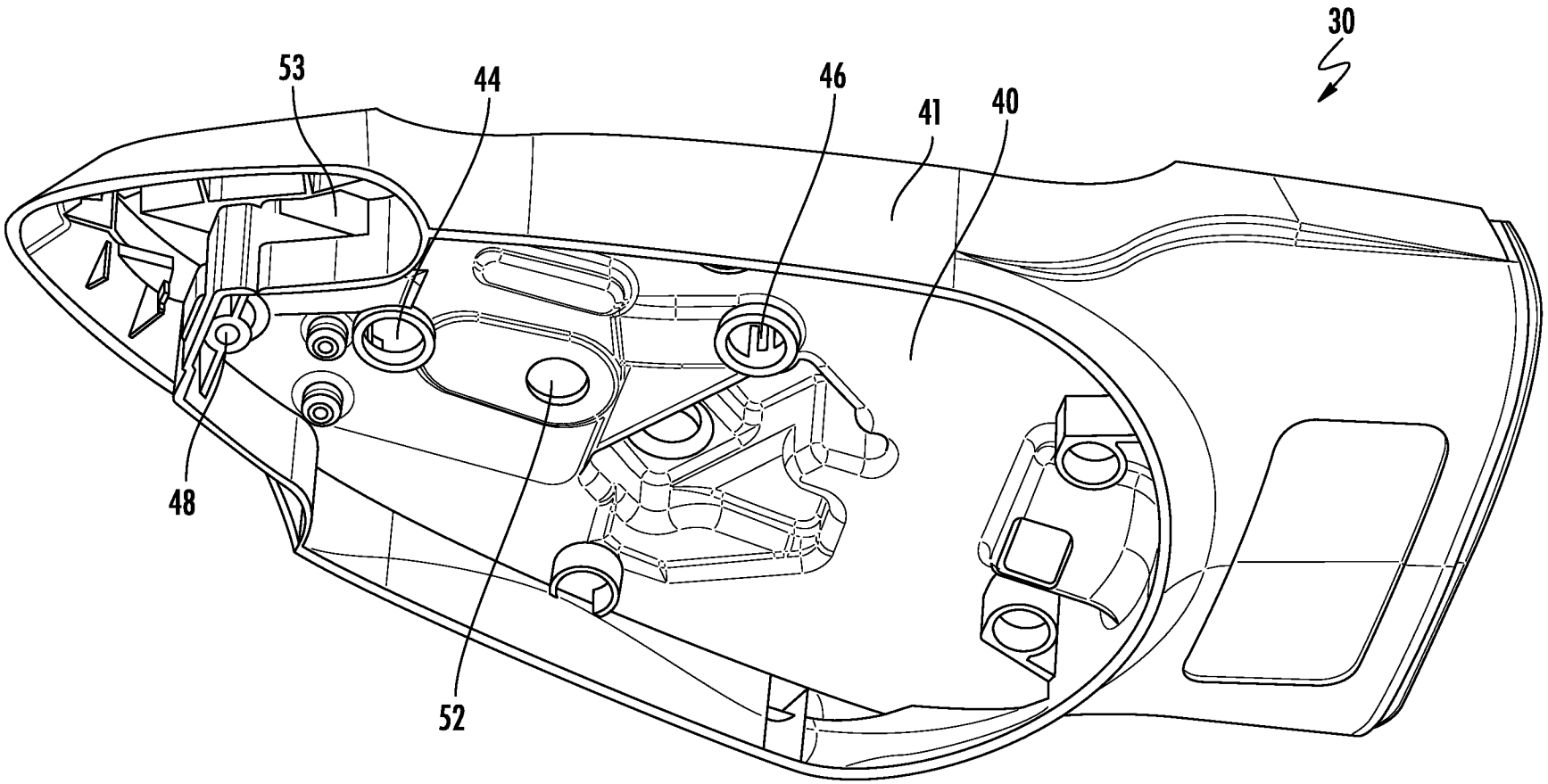
FIG. 8 is a bottom perspective view of the routing plate of FIG. 7.

Referring to FIGS. 7 and 8, the routing plate 30 overlies the cover plate 12*b* of the sole plate 12. The routing plate 30 has a main floor 40 surrounded on its front and sides by a wall 41 that forms much of the lower portion of the body 14. Within the main floor 40 are a central pedestal 42 with a large wiring hole 45, a steamer steam chamber entry port 44, a steamer steam chamber exit port 46 located beside the pedestal 42, an iron steam chamber entry port 52 located between the pedestal 42 and the steamer steam chamber entry port 44, and a nozzle steam entry port 48 located in front of the steamer steam chamber entry port 44. Guides 43 are arranged on one side of the pedestal to secure a line from the pump 22 (located at the rear of the unit) to the steamer steam chamber entry port 44, and guide 50 are arranged between the steamer steam chamber exit port 46 and the nozzle steam entry port 48 to secure a line therebetween.

Figure 9:
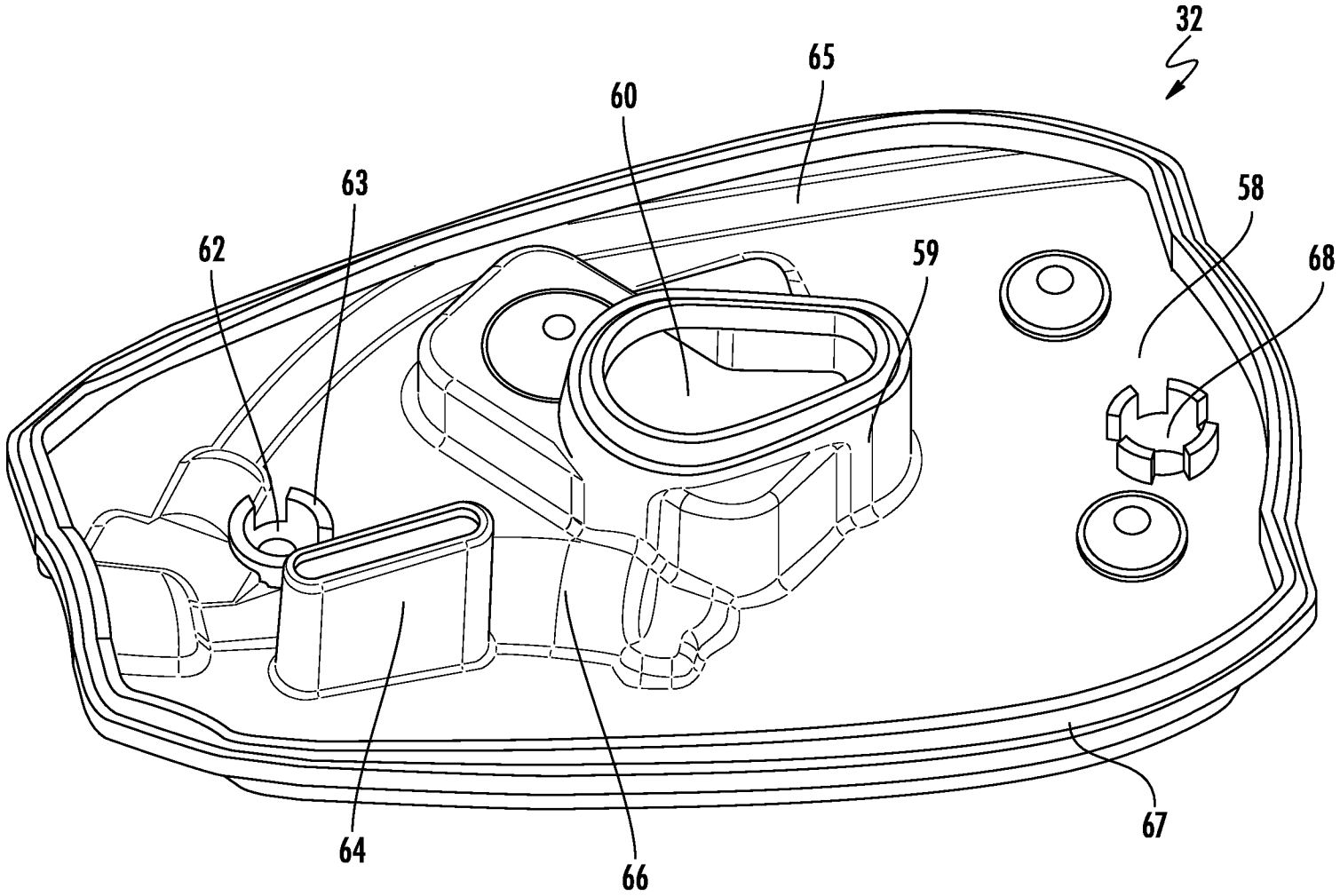
FIG. 9 is a top view of the water reservoir floor of the iron-steamer of FIG. 1.

Referring now to FIG. 9, the water reservoir floor 32 overlies the routing plate 30 and is not visible from the exterior of the iron-steamer 10. The water reservoir floor 32 has a main panel 58. A tower 59 with a central wiring hole 60 extends from the main panel 58 and is aligned with the wiring hole 43 of the routing plate 30. An iron water exit port 62 is located near the front of the water reservoir floor 32 (aligned with the iron steam chamber entry port 52) and is encircled by a split boss 63. An elongate, open projection 64 extends upwardly from the main panel 58. A pump port 68 is located near the rear of the main panel 58 and leads to the pump 22, which is located in the rear of the device. Guides 65, 66 are also present in the main panel 58 to overlie the guides 43, 52 of the routing panel 30.

Figure 10:
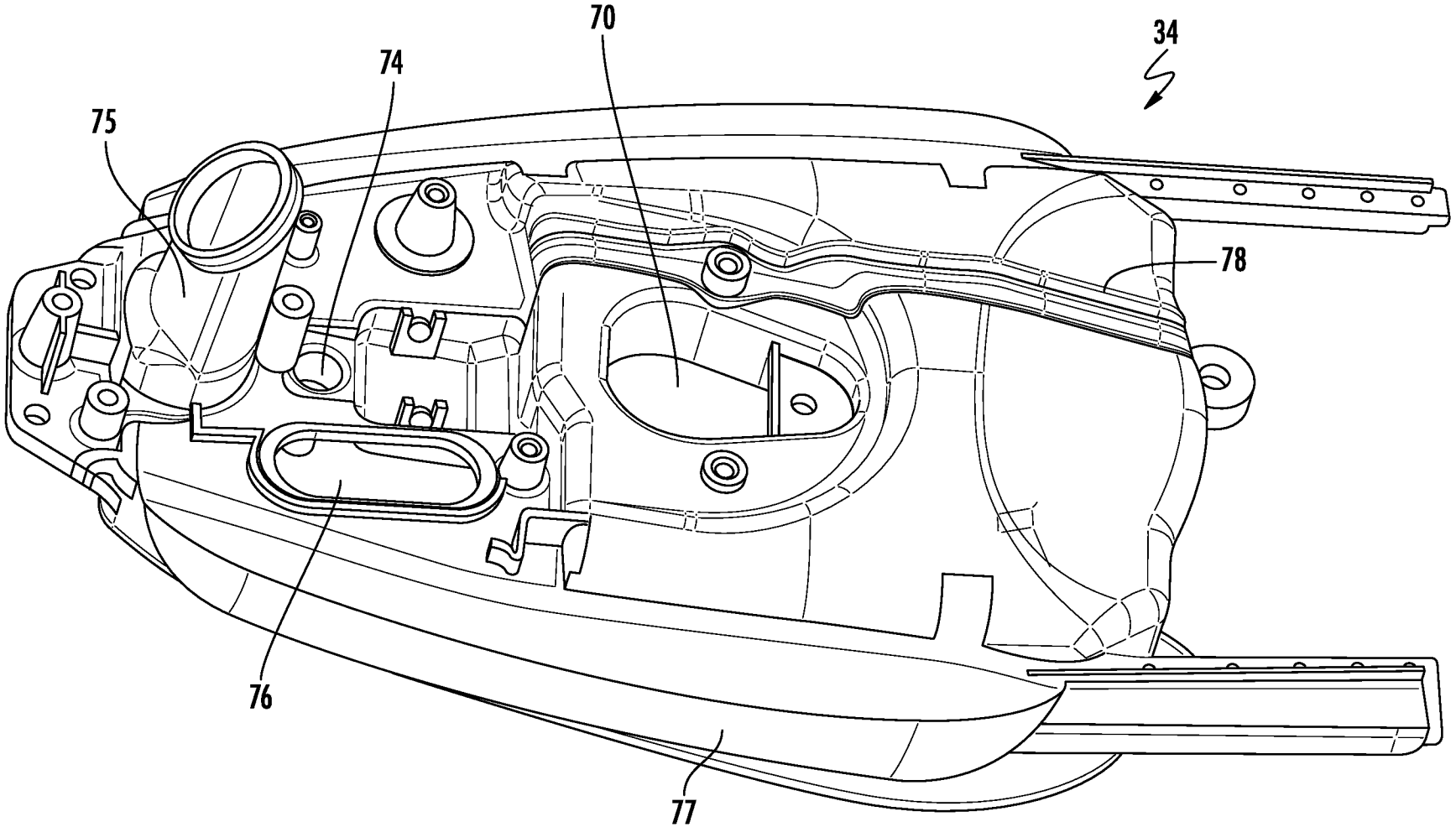
FIG. 10 is a top view of the water reservoir ceiling of the iron-steamer of FIG. 1.
Figure 11:
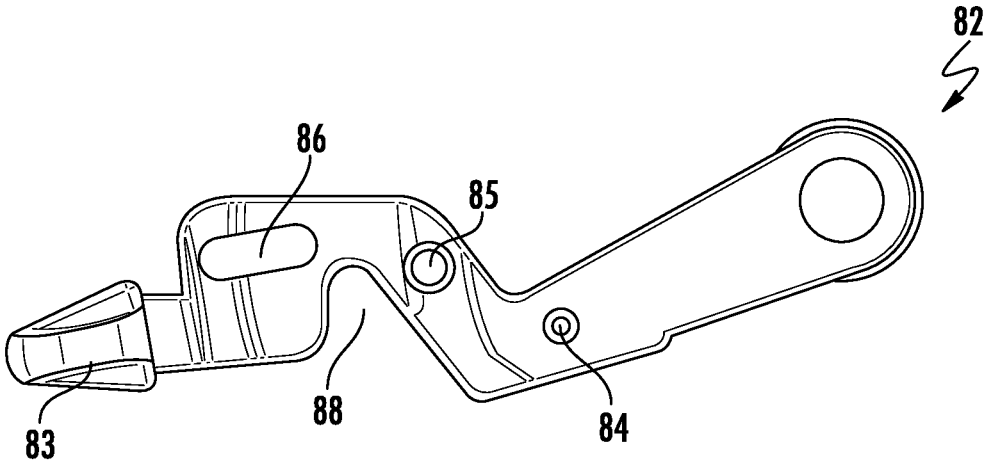
FIG. 11 is a top view of the selection lever of the selector mechanism of the iron-steamer of FIG. 1.

Referring now to FIG. 10, the water reservoir ceiling 34 overlies the water reservoir floor 32. The water reservoir ceiling 34 has a central wiring hole 70 that aligns with the wiring holes 43, 60. A steam shaft hole 74 is located forward of the wiring hole 70 and is aligned with the iron water exit port 62 and the iron steam chamber entry port 52. A water entry port 75 extends upwardly forwardly of the steam shaft hole 74 and is positioned to be in fluid communication with the water port 19. An elongate selector mechanism slot 76 is positioned laterally of the steam shaft hole 74 and receives the open projection 64 of the water reservoir floor 32. Side walls 77 of the water reservoir ceiling 34 meet side walls 67 of the water reservoir floor 32; the side walls 77, 67 are sealed, such that the floor 32 and ceiling 34 form the water reservoir 20 as a watertight cavity. The side walls 77 also form a visible portion of the body 14 of the iron-steamer 10; in some embodiments, the water reservoir ceiling 34 is formed of a transparent material, such that a user can visually discern the water level in the water reservoir 20.

Referring now to FIGS. 11-20, a selector mechanism 80 is shown therein. Beginning with FIG. 11, the selector mechanism 80 includes a lever 82 that is pivotally attached to the water reservoir ceiling 34 at a pivot 90. The lever has a grip 83 on its free end. A pin 84 extends upwardly near the pivot 90, and a post 85 extends upwardly radially outwardly of the pin 84. The lever 82 also includes a longitudinal slot 86 and a recess 88 in its rear edge between the slot 86 and the post 85.

Figure 12:
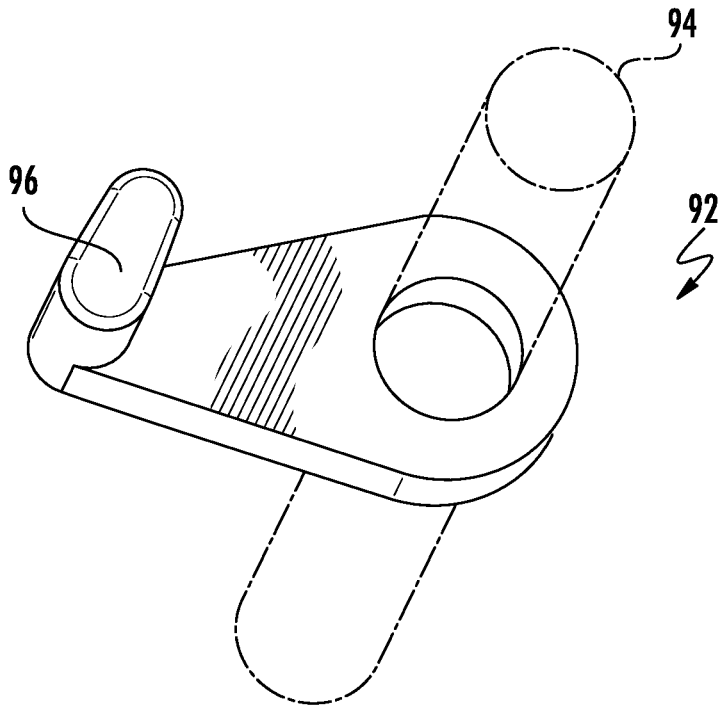
FIG. 12 is a perspective view of the follower of the selector mechanism of the iron-steamer of FIG. 1.

Referring now to FIG. 12, the selector mechanism 80 also includes a teardrop-shaped follower 92, which includes a main arm 93 that is disposed below the lever 82. The follower 92 includes a post 94 that extends both above and below the main arm 93 of the follower 92. The lower end of the post 94 is received in the open projection 64 of the water reservoir floor 32, which is within the slot 76 of the ceiling 34. At its lowest end, the post 94 is fixed to the rear end of a member 95 that is attached at its forward end to the steam nozzle 18. The follower 92 also includes an elongate cam 96 on the end opposite the post 94. A detent spring 97 (see FIG. 20) is mounted on the routing plate 30 to engage the post 94 and maintain it in one of three positions (described in detail below).

Figure 13:
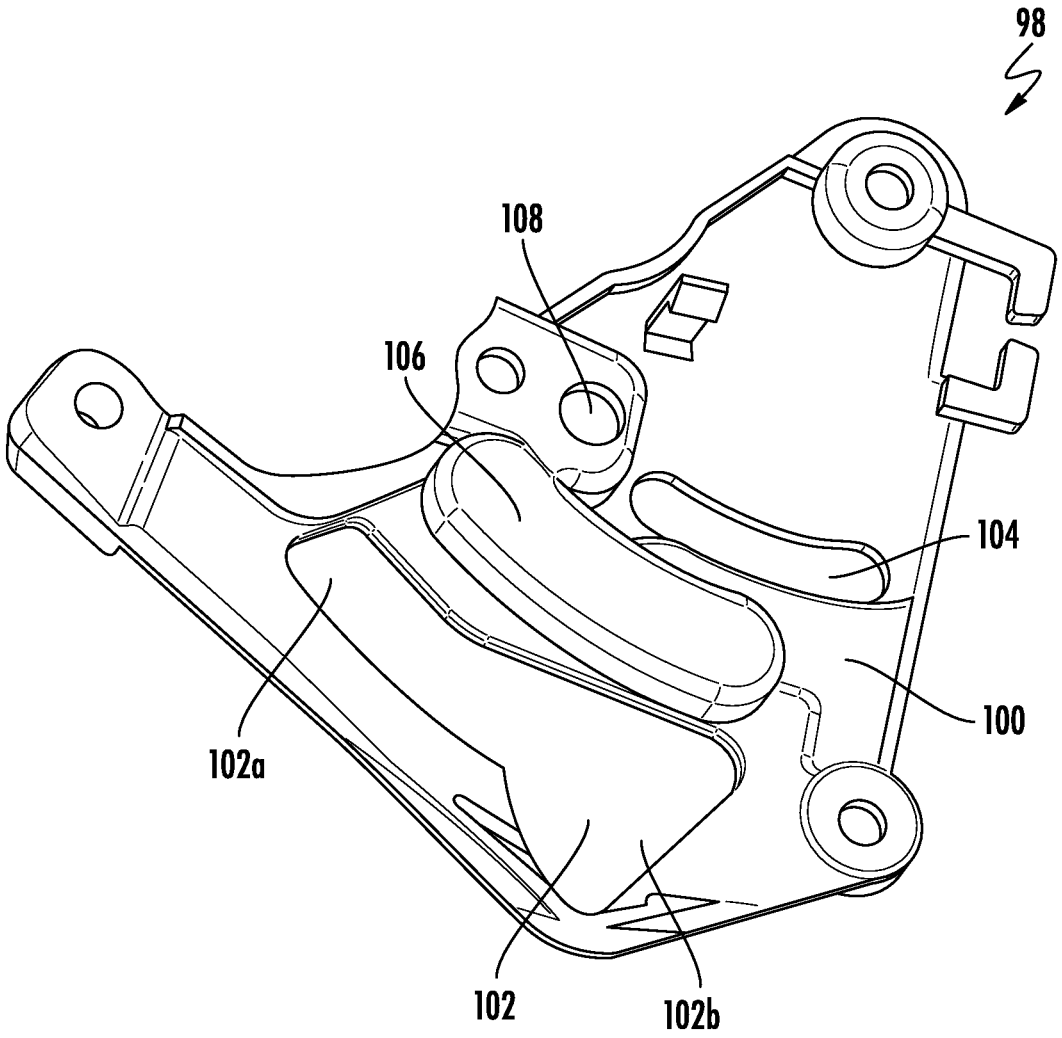
FIG. 13 is a perspective view of the housing of the selector mechanism of the iron-steamer of FIG. 1.

The selector mechanism 80 further includes a mechanism housing 98 mounted to the water reservoir ceiling 34 that generally overlies the lever 82 (see FIG. 13). The mechanism housing 98 has a main surface 100 with a cam aperture 102 having a narrower forward end 102*a* and a wider rear end 102*b*; the upper end of the post 94 of the follower 92 is received in the cam aperture 102. An arcuate slot 104 is also present in the main surface 100 and receives the pin 84 of the lever 82 from underneath. An arcuate pocket 106 extends upwardly from the main surface 100 and receives the post 85 of the lever 82. A steam shaft hole 108 is located adjacent the front end of the pocket 106.

Figure 14:
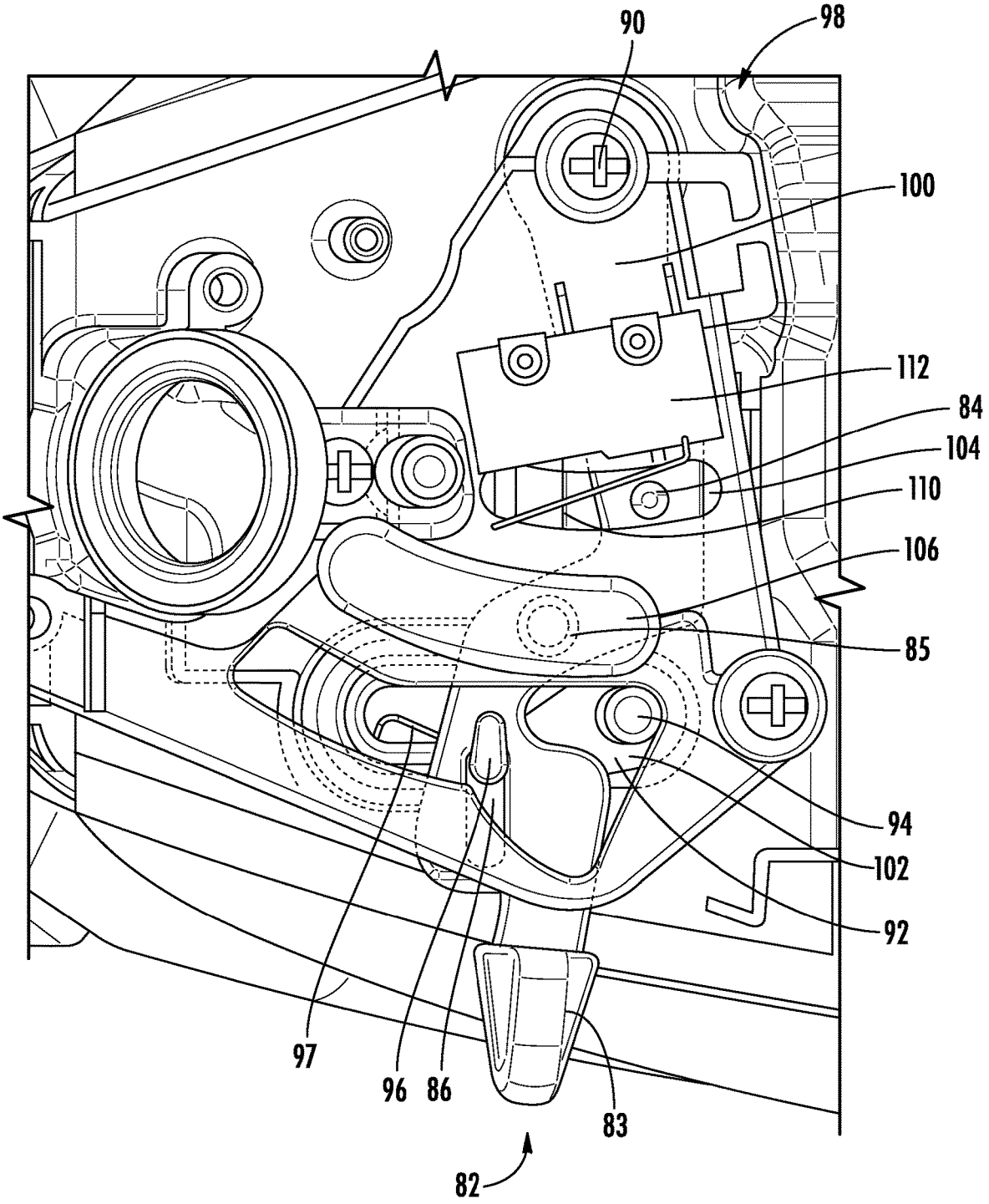
FIG. 14 is a top perspective view of the selector mechanism of the iron-steamer of FIG. 1, with the selection lever in the dry iron position.

Seen best in FIG. 14, an electric pump switch 112 is mounted on the main surface 100 adjacent the slot 104 and rearward of the steam shaft hole 108. A contact finger 110 is mounted to the side of the switch 112 slightly overhanging the slot 104. The switch 112 is electrically connected with the pump 22.

Best seen in FIG. 17, the selector mechanism 80 also includes a steam lever 116 that is pivotally attached at a pivot 118 to the water reservoir ceiling 34 below the lever 82. At its forward end, the steam lever 116 includes fingers 120 that engage a spring-loaded steam shaft 122 that fits within the steam shaft hole 108 of the housing 98. The steam shaft 122 seals against the hole 108 and serves as a valve to release water from the water reservoir 20. At its opposite end, the steam lever 116 includes an upwardly-extending finger 124 that engages the underside of the lever 82.

Figure 21:
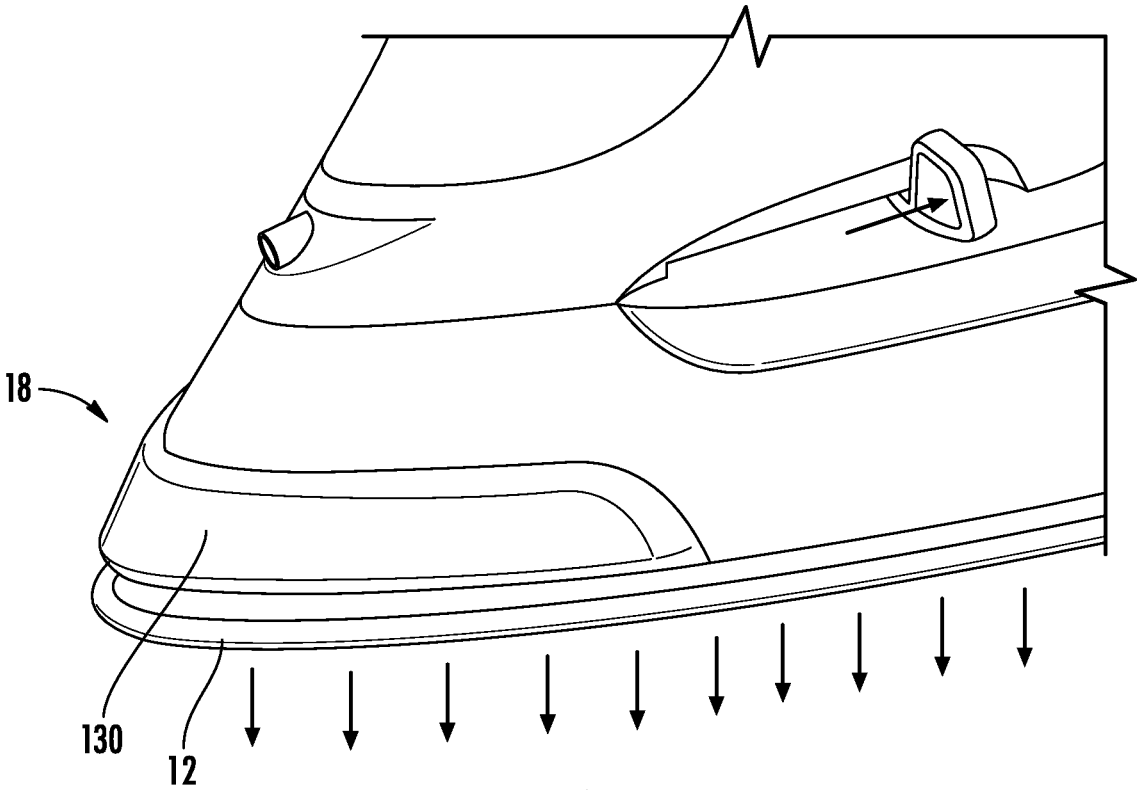
FIG. 21 is a partial side perspective view of the iron-steamer of FIG. 1 with the steamer nozzle in the retracted position.
Figure 22:
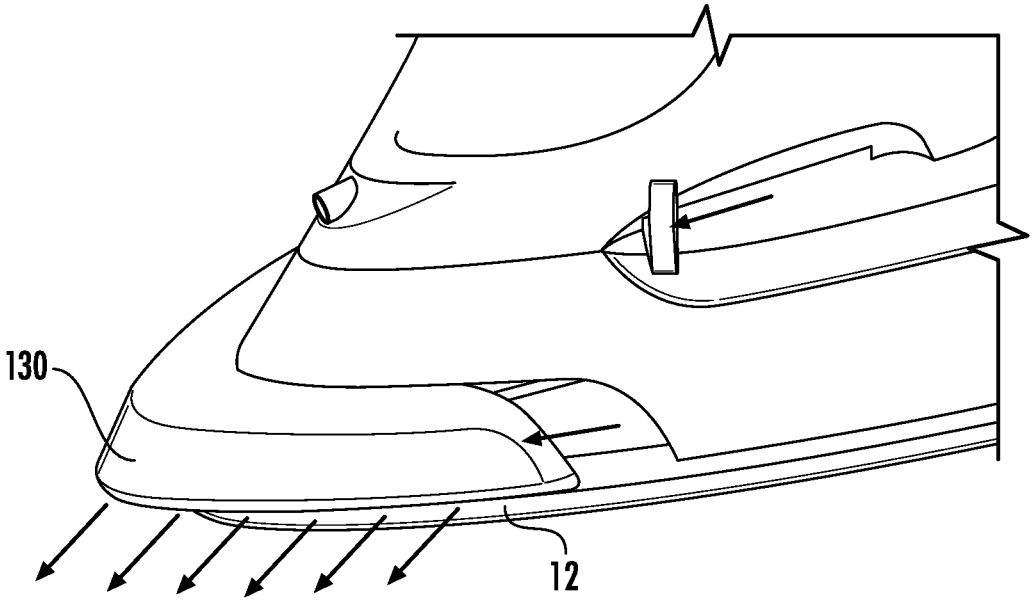
FIG. 22 is a partial side perspective view of the iron-steamer of FIG. 1 with the steamer nozzle in the extended position.
Figure 23:
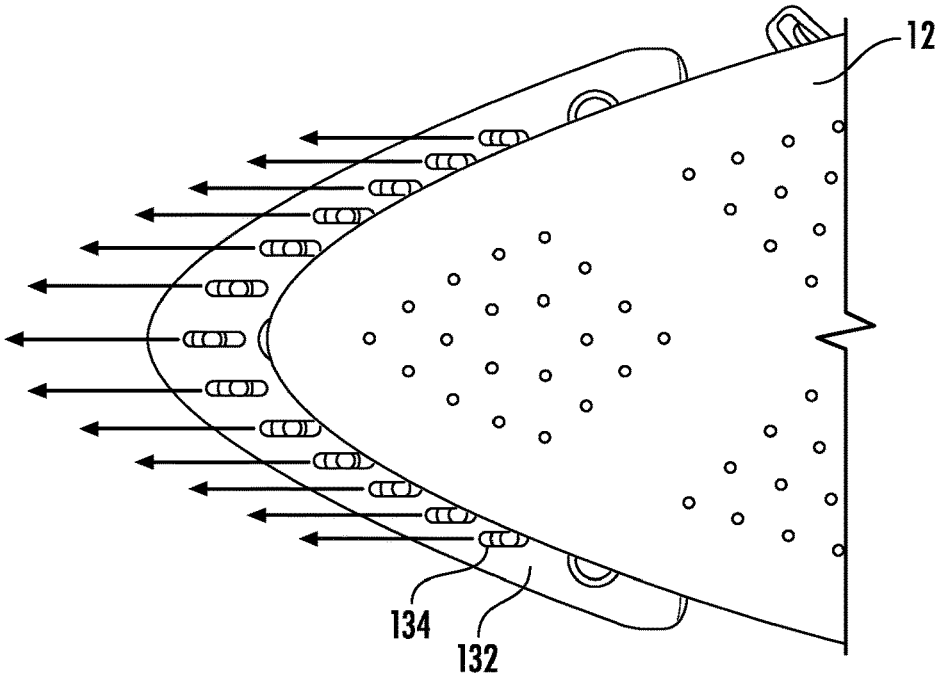
FIG. 23 is a bottom view of the iron-steamer of FIG. 1 with the steamer nozzle in the extended position.
Figure 24:
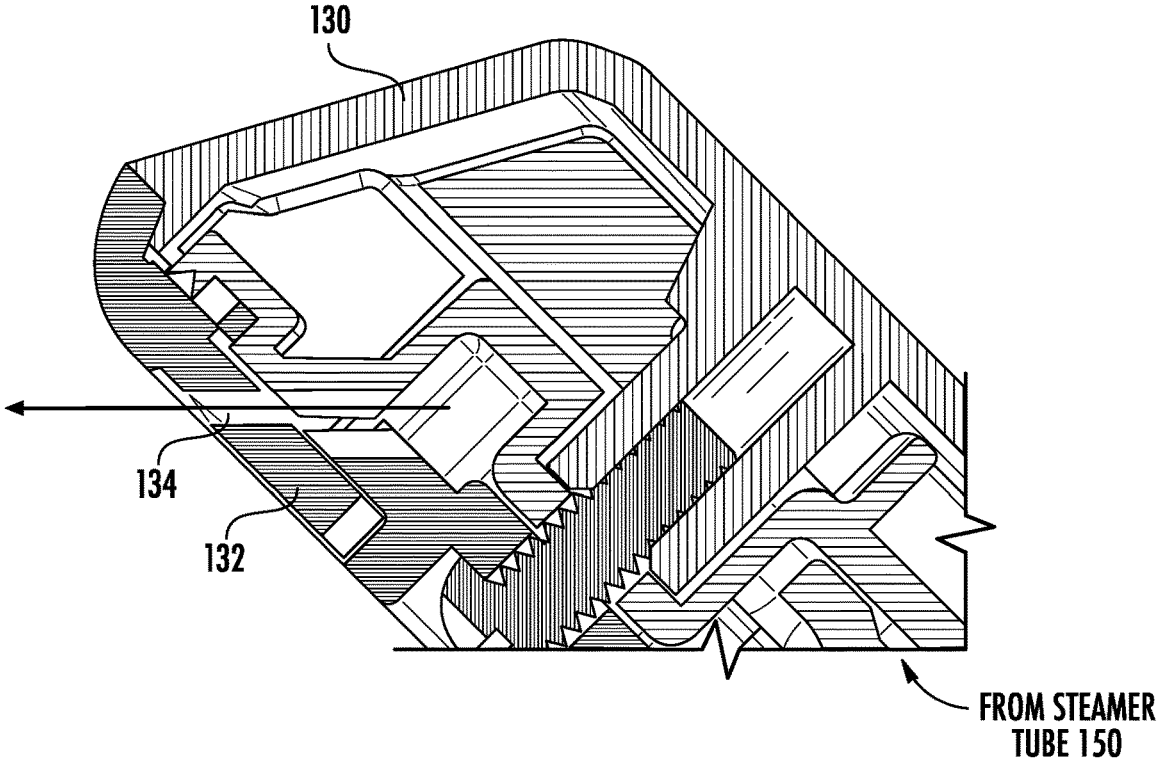
FIG. 24 is a side section view of the steamer nozzle of FIG. 23.

Referring now to FIGS. 21-24, the steamer nozzle 18 includes an outer shell 130 and a lower surface 132 with vents 134. The vents 134 are configured so that steam being expelled therefrom exits at approximately a 45 degree angle relative to the lower surface 132, as this angle is generally considered desirable for operating a steamer. The outer shell 130 is wider at the rear and narrows to a rounded nose in front, and also tapers from bottom to top. As can be seen in FIGS. 21-23, the steamer nozzle 18 can be moved (via the selector mechanism 80, as described in greater detail below) from a retracted position (FIG. 21), in which the steam nozzle 18 is positioned directly above the forward edge of the sole plate 12 and within the footprint of the sole plate 12 (and so that the nose of the outer shell 130 generally follows the contour of the housing 14—see FIG. 1), to an extended position, in which the forward portion of the steamer nozzle 18 is located forwardly of the footprint of the soleplate 12. In the extended position, the vents 134 are positioned forwardly of the soleplate 12 and therefore are able to expel steam onto a garment or the like. In some embodiments, in moving from the retracted to the extended position, the steamer nozzle 18 moves substantially parallel to the sole plate 12 and/or forwardly between about _____ and _____ inches.

Figure 5:
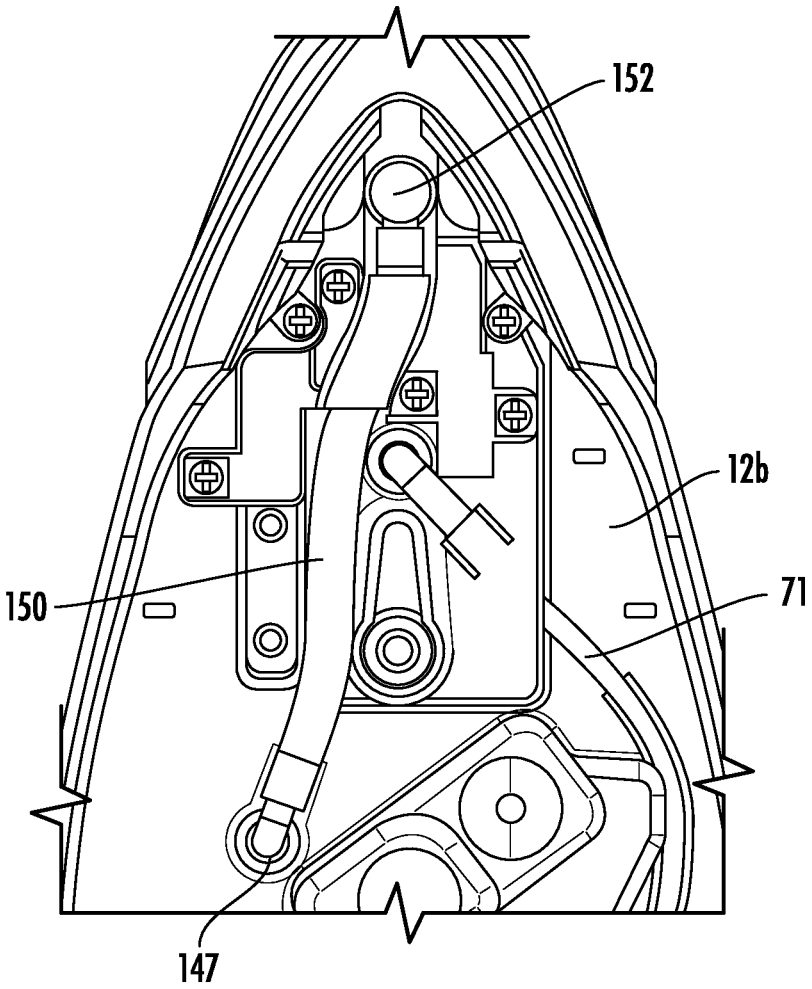
FIG. 5 is a cutaway top view of the cover plate of the sole plate of the iron-steamer of FIG. 1.

As can be seen in FIG. 5, the steamer nozzle 18 is fed by a steamer tube 150 that is routed between the exit port 147 of the steamer steam chamber 24 and a port 152 at the rear of the steamer nozzle 18. The steamer tube 150 follows at path defined by the guides 50 of the router plate 30. In some embodiments, the steamer tube 152 is of an accordion type that can stretch and retract in response to extension and retraction of the steamer nozzle 18. Alternatively, a telescoping tube may be employed.

The manner of operation of the iron-steamer 10 is dependent on the selection mechanism 80. If the selection lever 82 is in a middle position (see FIGS. 14, 15 and 19), the iron-steamer 10 operates as a dry iron. If the selection lever 82 is in a rear position (see FIGS. 16 and 17), the iron-steamer operates as a steam iron, with steam emitted from the vents 12*a* in the sole plate. If the selection lever 82 is in a forward position (see FIGS. 19 and 20), the iron-steamer 10 operates as a steamer, with steam emitted from the vents 134 in the steamer nozzle 18. The specific operation of the selection mechanism 80 is described below.

Figure 15:
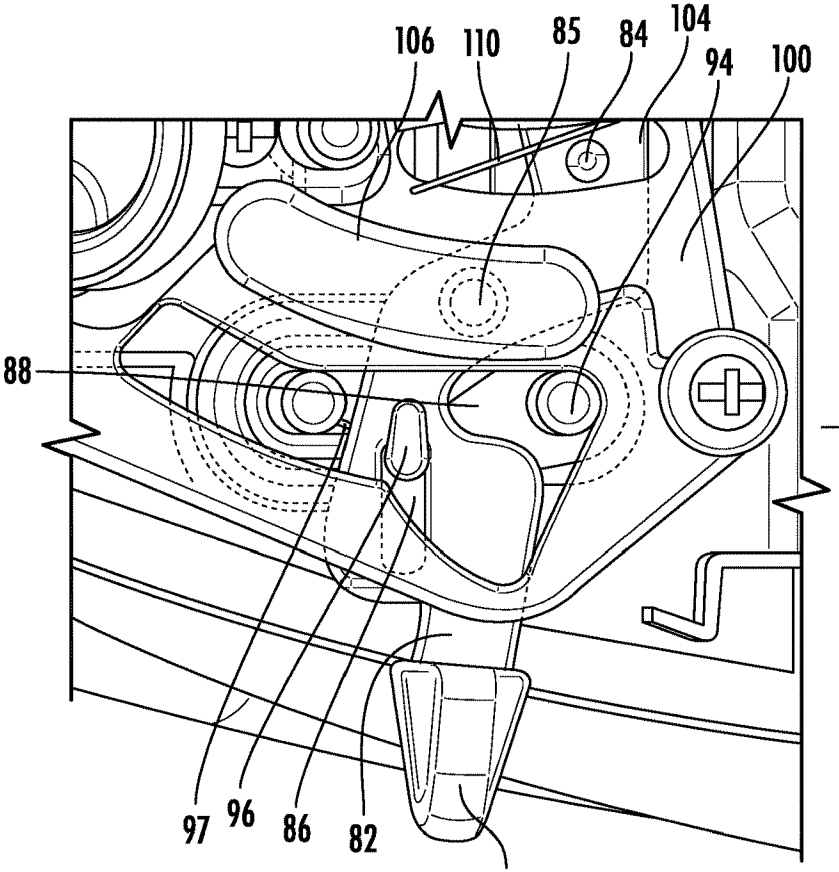
FIG. 15 a partial top perspective view of the selector mechanism of the iron-steamer of FIG. 1, with the selection lever in the dry iron position.
Figure 18:
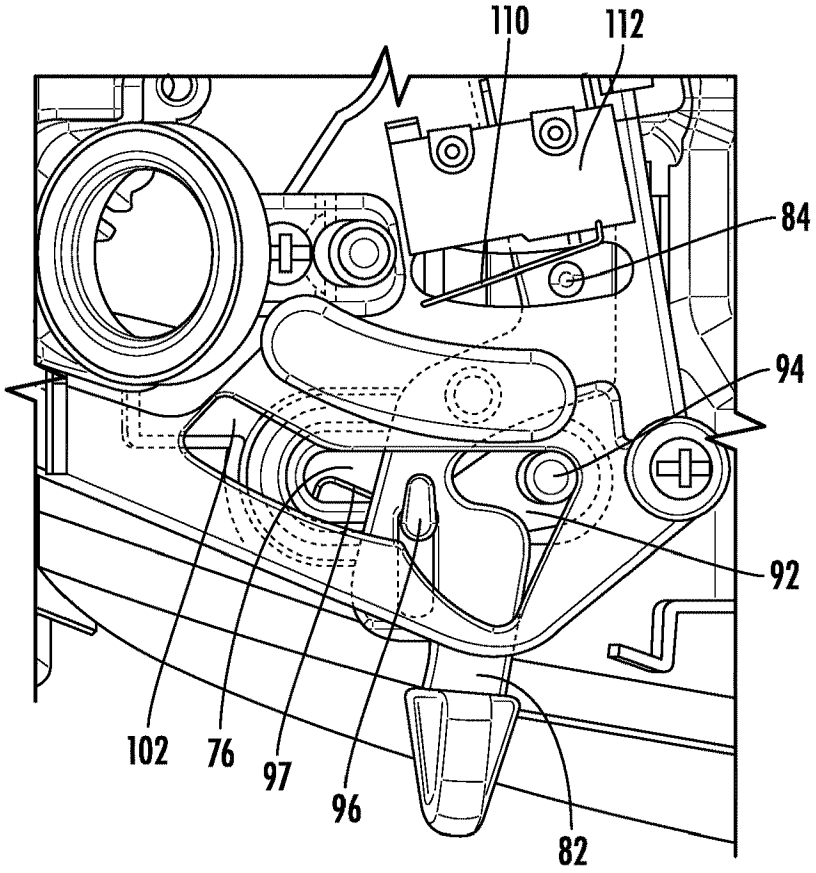
FIG. 18 is a partial top perspective view of the selector mechanism of FIG. 15 with the selection lever in the dry iron position.

FIGS. 14, 15 and 18 illustrate the selection mechanism 80 in the dry iron position. As can be seen in FIG. 14, in this position, the pin 84 of the selection lever 82 is located near the center of the slot 104 in the mechanism housing 98. The post 85 is located near the center of the recess 106. The follower 92 is oriented with the narrow end forward, the post 94 at the rear inner corner of the cam aperture 102, and the projection 96 at the inner end of the slot 86. With the selection lever 82 in this position, the post 85 does not engage the pump switch lever 114, so the pump 22 does not operate, and the steam lever 116 is pivoted such that its forward end is lowered, such that the steam shaft 122 is lowered and does not permit water to pass into the iron steam chamber 28. Thus, with no steam emitting from either the vents 12*a* or the vents 134, the iron-steamer operates as a dry iron.

Figure 16:
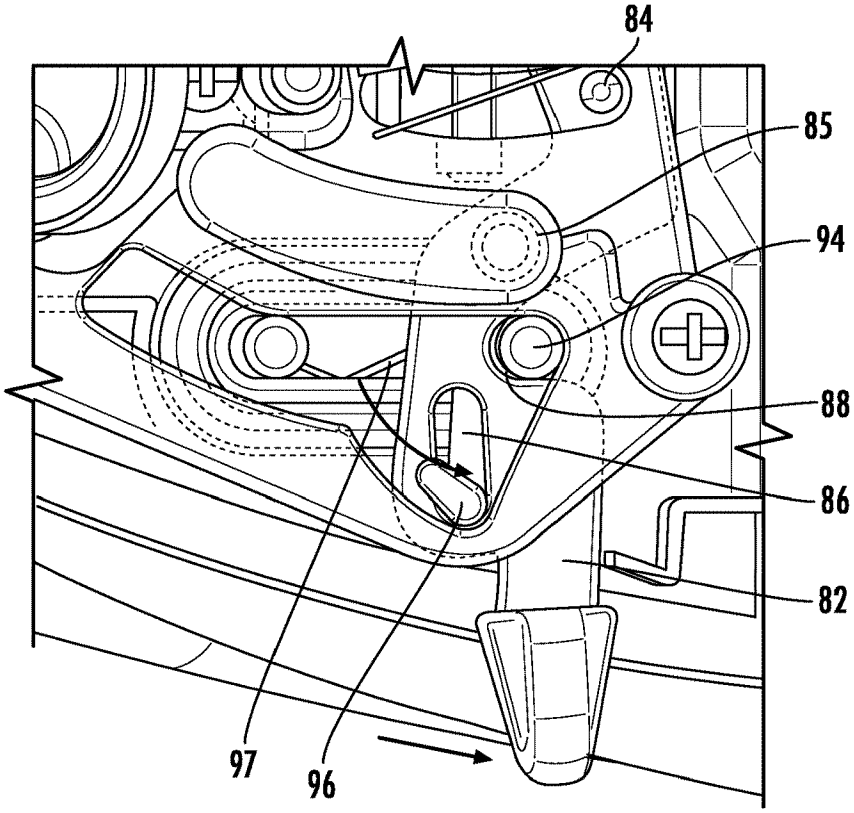
FIG. 16 is a partial top perspective view of the selector mechanism of the iron-steamer of FIG. 1, with the selection lever in the steam iron position.
Figure 17:
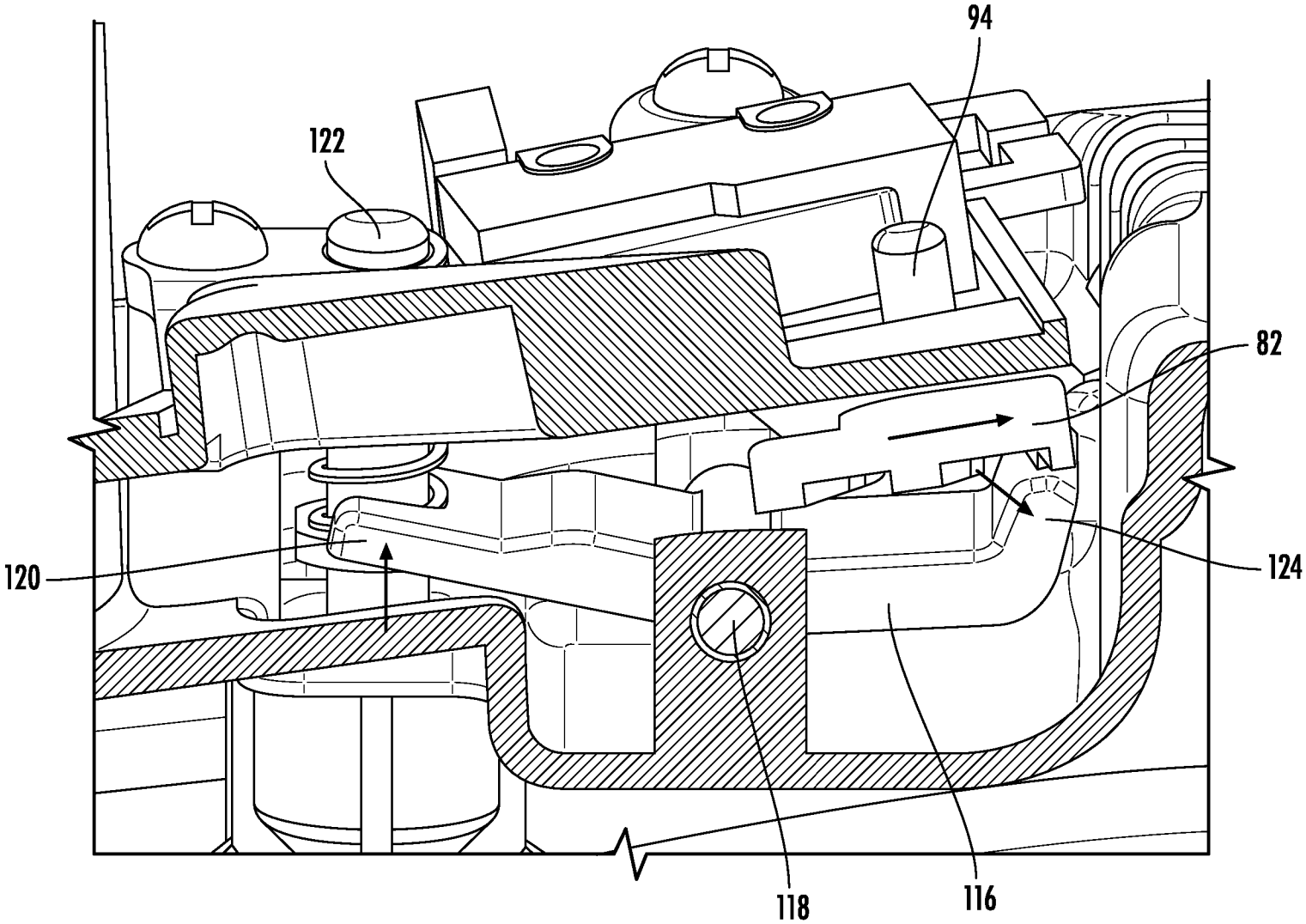
FIG. 17 is a side perspective section view of the selector mechanism of FIG. 16 showing the steam lever raising the steam shaft to allow water flow.

FIGS. 16 and 17 illustrate the selection mechanism 80 in the steam iron position. As shown in FIG. 16, pivoting of the selection lever 82 about the pivot 90 to the rearward position draws the projection 96 of the follower 92 rearwardly along the outer edge of the cam aperture 102; this action also rotates the follower 92 about the post 94, which is eventually captured by the recess 88 in the lever 82. As it moves to this position, the underside of the lever 82 engages the finger 124 of the steam lever 116. This action pivots the steam lever 116 about the pivot 118, with the rear end of the steam lever 116 being forced downwardly and the forward end of the steam lever 116 rising (see FIG. 17). The upward movement of the forward end of the steam lever 116 drives the steam shaft 122 upwardly. As the steam shaft 122 rises, water is free to flow downwardly from the water reservoir 20 through the iron water exit port 62 and into the iron steam chamber 28. The water is converted therein to steam and directed to the vents 12*a*, where the steam can be emitted onto a garment during ironing (controlled by the steam release button 15). Thus, with the lever 82 in the rear position, the iron-steamer 10 operates as a steam iron.

Figure 19:
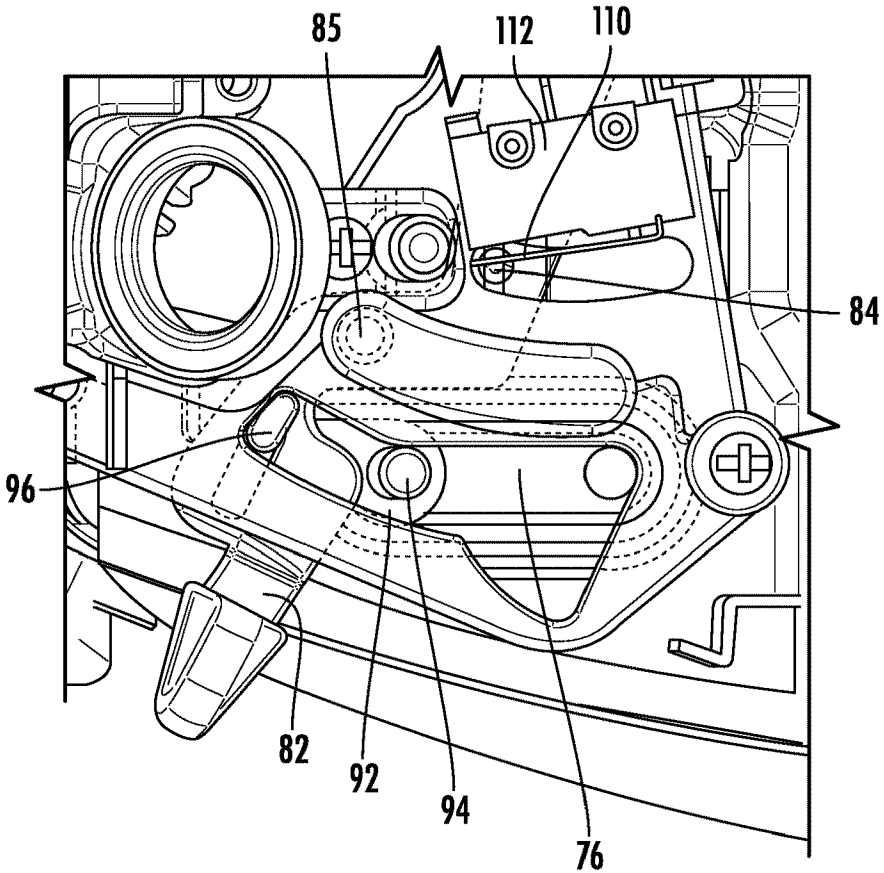
FIG. 19 is a partial top perspective view of the selector mechanism of FIG. 18 with the selection lever in the steamer position.
Figure 20:
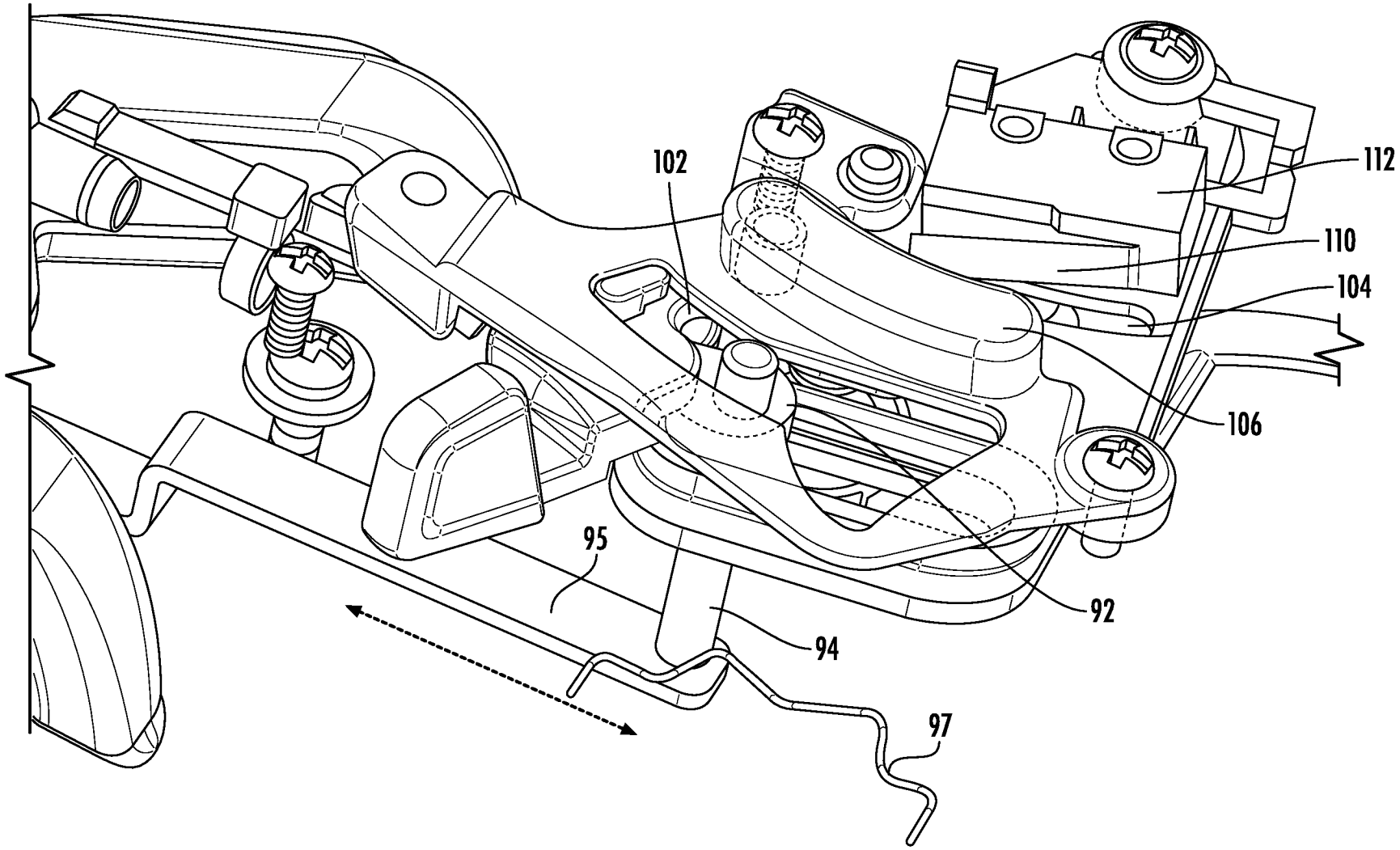
FIG. 20 is a top perspective view of the selector mechanism of FIG. 19 with the selection lever in the steamer position showing the member connecting the mechanism and the steamer nozzle.

FIGS. 19 and 20 show the selection mechanism in the steamer position. As shown in FIG. 19, pushing the knob 83 forward pivots the selection lever 82 about the pivot 90 to the forward position, which draws the follower 92 forward in the cam aperture 102. This movement also draws the post 94 forwardly (along the path defined by the selector mechanism slot 76), which in turn drives the member 95 and the steam nozzle 18 forwardly relative to the housing 14. This movement causes the vents 134 in the steam nozzle to "clear" the periphery of the sole plate 12 and therefore to position the vents 134 for unimpeded steaming. Also, forward movement of the lever 82 moves the pin 84 to the forward end of the slot 104. In moving to this position, the pin 84 engages and deflects the contact finger 110 of the pump switch 112, thereby activating the pump switch 112. Activation of the pump switch 112 causes the pump 22 to begin to pump water from the water reservoir 20 through the pump port 68, through a pump line 71 (FIG. 5), and into the steamer steam chamber 24. Once therein, the water is converted to steam and exits the steamer steam chamber 24 into the steamer tube 150, wherein it is routed to the steamer nozzle 18 and ultimately to the vents 134. Steam is emitted from the vents 134 onto to garment. Thus, movement of the lever 82 to the forward position causes the iron-steamer 10 to operate as a continuous steamer.

In a configuration such as that shown herein, the iron-steamer 10 provides dry iron, steam iron and steamer functions, and does so with a device that has the aesthetically pleasing appearance of a typical steam iron. Also, retraction of the steamer nozzle 18 such that its shell 130 follows the general contour of the remainder of the housing 14 keeps the steamer nozzle 18 out of the way when not in use.

Those of skill in this art will appreciate that the iron-steamer 10 may take other forms. For example, the selection mechanism 80 may be configured differently. As one example, the selection lever may be one member of a two-member "scissors" configuration. Rearward movement of the selection lever opens of the "scissors" and slides one end of the selection lever under a projection that causes the steam shaft to rise and allow water to drip into the steam chamber for steam iron operation. Closure of the scissors via forward movement of the selection lever returns the mechanism to the dry iron position. Further forward movement of the selection lever moves the "closed" scissors members forward as they pivot relative to the water reservoir ceiling, which forces a follower forward; the follower is attached to a drive member that is also attached to the steamer nozzle, which forces it forward. The pivoting movement of the closed scissors also causes a pin to engage the finger on the pump switch, thereby activating the pump to produce steam for the steamer.

As another alternative embodiment of the selection mechanism, the pump switch 112 may be inverted, such that rearward movement of the lever 82 deflects the contact finger 110 to activate the pump (with an accompanying modification of the member 95 to a scissors or other linkage that forces the steamer nozzle 18 forward), and forward movement of the lever 82 lifts the steam shaft 116. As a further example, the follower 92 may be configured differently, with a cam opening 102 that is reshaped accordingly. The post 85 may be omitted. A valve other than the steam shaft 122 may be employed. Other variations may be contemplated.

In addition, in some embodiments the pump 22 may be omitted, such that water is provided to the steamer team chamber via gravimetric flow. In other embodiments, a pump may be employed to convey from the water reservoir to the iron steam chamber.

As a further example, in some embodiments the steamer nozzle 18 may move from its retracted position to the extended position in a direction that is not substantially parallel to the sole plate 12. For example, the steamer nozzle 18 may move forward, but may move upwardly also and separate somewhat from the sole plate. Other possible variations may also be recognized by those skilled in this art.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An iron-steamer appliance, comprising:

an appliance housing including an internal water reservoir;

a sole plate attached under the appliance housing, the sole plate including first vents;

first and second steam chambers in fluid communication with the water reservoir, wherein the first steam chamber is in fluid communication with the first vents;

a steamer nozzle in fluid communication with the second steam chamber, the steamer nozzle including second vents, the steamer nozzle is movable between retracted and extended positions, wherein in the retracted position, the nozzle is located directly above a peripheral footprint defined by the sole plate where the second vents directly overlie the sole plate, and in the extended position, the nozzle is located at least partially forwardly of the sole plate peripheral footprint where the second vents do not overlie the sole plate, and wherein in moving from the retracted position to the extended position, the steamer nozzle moves substantially parallel to the sole plate; and wherein the steamer nozzle further comprises a steam nozzle housing, wherein in the retracted position the steamer nozzle housing follows a contour defined by the appliance housing, and in the extended position, the steamer nozzle housing is forward of the contour defined by the appliance housing.

2. The appliance defined in claim 1, further comprising a pump mounted in the appliance housing, the pump fluidly connected between the water reservoir and the second steam chamber.

3. The appliance defined in claim 1, wherein the first steam chamber is sealed and separate from the second steam chamber.

4. The appliance defined in claim 3, wherein a steamer tube is connected between the second steam chamber and the steamer nozzle.

5. The appliance defined in claim 4, wherein the steamer tube is configured to expand in length in the extended position and retract in length in the retracted position.

6. The appliance defined in claim 1, further comprising a selector mechanism, the selector mechanism configured to select (a) a dry iron setting, in which steam is emitted from neither the first or second vents, (b) a steam iron setting, in which steam is emitted from the first vents but not from the second vents, and (c) a steamer setting, in which steam is emitted from the second vents but not from the first vents.

7. The appliance defined in claim 6, wherein the selector mechanism comprises a selector lever, wherein the selector lever is in a forwardmost position in the steamer setting, a rearwardmost position in the steam iron setting, and an intermediate position in the dry iron setting.

8. The appliance defined in claim 7, wherein the selector mechanism further comprises a follower that engages the selector lever and slides relative to the water reservoir, and a member attached to the follower that is attached to the steamer nozzle, such that forward movement of the selector lever from the dry iron setting to the steamer setting drives the follower, the member and the steamer nozzle forward.

9. The appliance defined in claim 7, wherein a steam shaft is positioned to selectively prevent flow of water from the water reservoir to the first steam chamber, wherein the selector mechanism includes a steam lever that engages the steam shaft, and wherein movement of the selector lever to the steam iron setting engages the steam shaft and causes the steam lever to move the steam shaft to permit the flow of water from the water reservoir into the first steam chamber.

10. An iron-steamer appliance, comprising:

an appliance housing including an internal water reservoir;

a sole plate attached under the appliance housing, the sole plate including first vents;

first and second steam chambers in fluid communication with the water reservoir, wherein the first steam chamber is in fluid communication with the first vents;

a steamer nozzle in fluid communication with the second steam chamber, the steamer nozzle including second vents, the steamer nozzle is movable between retracted and extended positions, wherein in the retracted position, the second vents directly overlie the sole plate, and in the extended position, the second vents do not overlie the sole plate the steamer nozzle including a steamer nozzle housing, the steamer nozzle housing following a contour defined by the appliance housing when the steamer nozzle is in the retracted position and the steamer nozzle being forward of the contour defined by the appliance housing when the steamer nozzle is the extended position;

a selector mechanism, the selector mechanism configured to select (a) a dry iron setting, in which steam is emitted from neither the first or second vents, (b) a steam iron setting, in which steam is emitted from the first vents but not from the second vents, and (c) a steamer setting, in which steam is emitted from the second vents but not from the first vents, the selector mechanism comprising a selector lever, wherein the selector lever is in a forwardmost position in the steamer setting, a rearwardmost position in the steam iron setting, and an intermediate position in the dry iron setting; and the selector mechanism further comprising a follower that engages the selector lever and slides relative to the water reservoir, and a member attached to the follower that is attached to the steamer nozzle, such that forward movement of the selector lever from the dry iron setting to the steamer setting drives the follower, the member and the steamer nozzle forward.

11. The appliance defined in claim 10, further comprising a pump mounted in the appliance housing, the pump fluidly connected between the water reservoir and the second steam chamber.

12. The appliance defined in claim 10, wherein the first steam chamber is sealed and separate from the second steam chamber.

13. An iron-steamer appliance, comprising:

an appliance housing including an internal water reservoir;

a sole plate attached under the housing, the sole plate including first vents;

first and second steam chambers in fluid communication with the water reservoir, wherein the first steam chamber is in fluid communication with the first vents;

a steamer nozzle in fluid communication with the second steam chamber, the steamer nozzle including a steamer nozzle housing and second vents;

wherein the steamer nozzle is movable between retracted and extended positions, and wherein in the retracted position the steamer nozzle housing follows a contour defined by the appliance housing and second vents directly overlie the soleplate, and in the extended position, the steamer nozzle housing is forward of the contour defined by the appliance housing such that the second vents are forward of the soleplate; and a pump mounted in the appliance housing, the pump fluidly connected between the water reservoir and the second steam chamber.

14. The appliance defined in claim 13, wherein the first steam chamber is sealed and separate from the second steam chamber.

15. The appliance defined in claim 13, further comprising a selector mechanism, the selector mechanism configured to select (a) a dry iron setting, in which steam is emitted from neither the first or second vents, (b) a steam iron setting, in which steam is emitted from the first vents but not from the second vents, and (c) a steamer setting, in which steam is emitted from the second vents but not from the first vents.

* * * * *